US007267261B2

(12) United States Patent
Lo Duca

(10) Patent No.: US 7,267,261 B2
(45) Date of Patent: Sep. 11, 2007

(54) BOX WITH A BASE RESISTANT TO OPENING AND HAVING PORTIONS THEREOF BREAKABLE TO PREVENT THE BOX FROM BEING RECLOSED AFTER INITIAL OPENING THEREOF

(75) Inventor: Carmelo Lo Duca, Milan (IT)

(73) Assignee: GI.BI.EFFE S.r.l., Milan (IT)

( * ) Notice: Subject to any disclaimer, the term of this patent is extended or adjusted under 35 U.S.C. 154(b) by 1 day.

(21) Appl. No.: 11/240,461

(22) Filed: Oct. 3, 2005

(65) Prior Publication Data

US 2006/0124708 A1 Jun. 15, 2006

(30) Foreign Application Priority Data

Dec. 15, 2004 (IT) ..... MI2004A2387

(51) Int. Cl.
*B65D 5/00* (2006.01)
*B65D 17/00* (2006.01)

(52) U.S. Cl. ..... 229/102; 229/148; 229/153; 229/240

(58) Field of Classification Search ..... 229/102, 229/148, 151, 152, 153, 155, 156, 240, 241, 229/244

See application file for complete search history.

(56) References Cited

U.S. PATENT DOCUMENTS

| | | | | |
|---|---|---|---|---|
| 2,116,652 | A * | 5/1938 | Adler | 229/148 |
| 3,128,934 | A * | 4/1964 | Jacke | 229/102 |
| 3,233,818 | A * | 2/1966 | Bixler et al. | 229/102 |
| 3,462,066 | A * | 8/1969 | Farquhar | 229/102 |
| 3,861,583 | A * | 1/1975 | Tingley et al. | 229/149 |
| 4,063,678 | A * | 12/1977 | Hall | 229/102 |
| 4,890,789 | A * | 1/1990 | Lo Duca | 229/102 |
| 5,207,374 | A | 5/1993 | Lo Duca | |
| 6,913,140 | B2 | 7/2005 | Lo Duca | |
| 2004/0011858 | A1 | 1/2004 | Lo Duca | |
| 2004/0262195 | A1 | 12/2004 | Lo Duca | |
| 2005/0116016 | A1 | 6/2005 | Lo Duca | |
| 2005/0121359 | A1 | 6/2005 | Lo Duca | |

FOREIGN PATENT DOCUMENTS

| | | |
|---|---|---|
| DE | 93 06 209.5 | 7/1993 |
| EP | 0 709 293 A1 | 5/1996 |
| FR | 2 847 555 | 5/2004 |
| FR | 2 861 695 | 5/2005 |
| GB | 2271760 A * | 4/1994 |

* cited by examiner

*Primary Examiner*—Gary Elkins
(74) *Attorney, Agent, or Firm*—Oblon, Spivak, McClelland, Maier & Neustadt, P.C.

(57) ABSTRACT

A box with at least one base is disclosed which is resistant to opening and of which portions become broken off to prevent the base being reclosed after being opened for the first time. The base includes a panel projecting from the box and a tab projecting from and separated from the panel by a folding line in which there is provided a cut through which hook-shaped teeth extend and hook thereonto, these latter projecting from two opposing lateral flaps positioned below said panel in the box when closed. In this base panel there are provided knurlings which extend from each end of said cut as far as the adjacent lateral edge of the panel, to hence define portions which break away from the base of the box.

3 Claims, 2 Drawing Sheets

BOX WITH A BASE RESISTANT TO OPENING AND HAVING PORTIONS THEREOF BREAKABLE TO PREVENT THE BOX FROM BEING RECLOSED AFTER INITIAL OPENING THEREOF

BACKGROUND OF THE INVENTION

1. Field of the Invention

The present invention relates to a box of the type having at least one base with high resistance to opening, and more particularly to a box with one or more closure bases or lids comprising cuts into which there extend hook-shaped teeth projecting from flaps below each base or lid, said teeth interfering with the base to substantially increase its resistance to opening.

2. Discussion of the Background

More particularly, the invention relates to a box of the aforesaid type, the base or lid of which becomes irredeemably broken, to prevent it from being reclosed after the base has been opened for the first time.

U.S. Pat. No. 4,890,789, the corresponding EP-B-0318750 and DE-A-3826231 describe boxes provided with at least one base or lid with high resistance to opening: this lid comprises a panel projecting from the box and having a projecting tab which can be folded and inserted into the interior of the box to the side of one or more flaps projecting from respective main lateral panels of the box and positioned below, i.e. on the inside, of the lid considered.

In and along the folding line which separates the lid panel from the tab there is provided a thin elongate window into which there become inserted (when the box is closed) two hooks or dovetail shaped teeth projecting one from each of the said flaps and superposed one above the other in the box when closed.

When the lid is pulled to open it, it drags and raises the said two teeth (which extend into said elongate window of the lid tab) away from their rest position: as the teeth are rigid with the flaps which are connected to the adjacent lateral panels of the box along folding lines inclined (generally perpendicular) to the folding line about which the lid can rotate, it follows that the raising of the two teeth (by the effect of the pull exerted on them by the lid to be opened) causes the teeth to move along two different circular arcs and to withdraw from each other within the window in which they are inserted, to hence strongly hook onto the tab in which this window is provided.

The result is that the resistance to opening of the box lid is strongly increased by the retention action exerted on it by the teeth projecting from the box flaps.

This does not prevent it being possible, using suitable care, to unhook the lid from the hook-shaped teeth of the flaps and open the box lid (or lids), to then reclose it such that its previous opening goes unnoticed.

U.S. Pat. No. 5,207,374, EP-B-0709293 and EP-A-1340684 describe boxes comprising a lid consisting of a closure panel from which there extends a foldable tab insertable into the box interior, in said tab there being provided two separate apertures which extend along the folding line separating the tab from the closure panel, below which two separate non-superposable flaps projecting from two lateral main walls of the box become positioned. From each flap there projects only one hook-shaped tooth which is inserted into one of the two said apertures to hook to it and hence hinder the opening of the box lid: these arrangements however suffer from the drawback that the box base can be opened by delicately deforming the closure panel firstly on one side and then on the other, to firstly uncouple one hook-shaped tooth and then the other hook-shaped tooth from their respective apertures.

In EP-B-0709293 a knurling is provided extending along the panel and along the entire width of the respective tab on the box base so that when this base is opened for the first time, the hook-shaped tooth (provided on that side of the base comprising said knurling) causes this knurling to break with consequent simultaneous detachment of a portion both of the tab and of the panel, hence making it easily visible that a part of the base is lacking, i.e. that it has already been opened for the first time. In this respect it is important to note that the traction force causing the knurling to break is applied by the hook-shaped tooth at an intermediate point of the entire said knurling, signifying that when the box is opened for the first time by pulling its base, this base outwardly raises the underlying flap, the hook-shaped tooth of which has to simultaneously break both that portion of knurling extending along the panel and that portion of knurling extending along the tab projecting from it. This operation, which is effected and completed while the hook-shaped tooth is raised and displaced from the box base pulled with two fingers by the person opening the box, is certainly not easy and can happen without the hook-shaped tooth deforming and uncoupling from the respective base aperture in which it is housed in the box.

In EP-A-1340684, along the entire folding line separating the tab from the respective panel in each base of the box, a knurling is provided which is broken (to hence totally detach the tab from the panel) when this base is opened for the first time, the breakage again being caused by the hook-shaped teeth projecting from the flaps below the base panel, with the same drawbacks as the aforesaid.

SUMMARY OF THE INVENTION

The main object of the present invention is to provide a box having at least one base resistant to opening, in which the base can be opened only after direct easy manual removal of portions of the base, by tearing knurlings provided only on the base panel.

This and further objects are attained by a box formed from a single piece of punched, crease-lined or knurled cardboard, comprising four lateral walls, at least one lid or base projecting from an end of said lateral walls, two flaps each projecting from the end of a respective lateral wall adjacent to that from which said base projects, said base consisting of a panel projecting directly from the lateral wall of the box and a tab projecting from the free end of said panel, the panel being separated from the respective lateral wall and from the tab by parallel folding lines, said flaps also being separated from the respective lateral walls by folding lines and each having a hook-shaped tooth provided in proximity to the free end of the flap on that side thereof opposite the box base panel, the length of the two flaps being such that when they are folded one towards the other in the box when closed, the hook-shaped tooth of one flap becomes superposed on the hook-shaped tooth of the other flap, in the box base tab in proximity of the folding line which separates it from the panel from which it projects there being provided a cut within which the hook-shaped teeth projecting from the two flaps on which the base panel is superposed in the box when closed are positioned and extend, the box being characterized in that a breakable knurling extends from each end of said cut as far as the adjacent lateral edge of the base panel.

Preferably, said knurlings provided on the bottom of the lid extend along circular arcs.

Again preferably, on that free edge of the lateral wall where the hook-shaped teeth are positioned in the box when closed, a central recess is provided adjacent to said cut provided in the tab of the box base.

BRIEF DESCRIPTION OF THE DRAWINGS

For a clearer understanding of the structure and characteristics of the box according to the invention, a preferred embodiment thereof is described hereinafter by way of non-limiting example with reference to the accompanying drawings, in which.

DETAILED DESCRIPTION OF THE INVENTION

Figure 1:
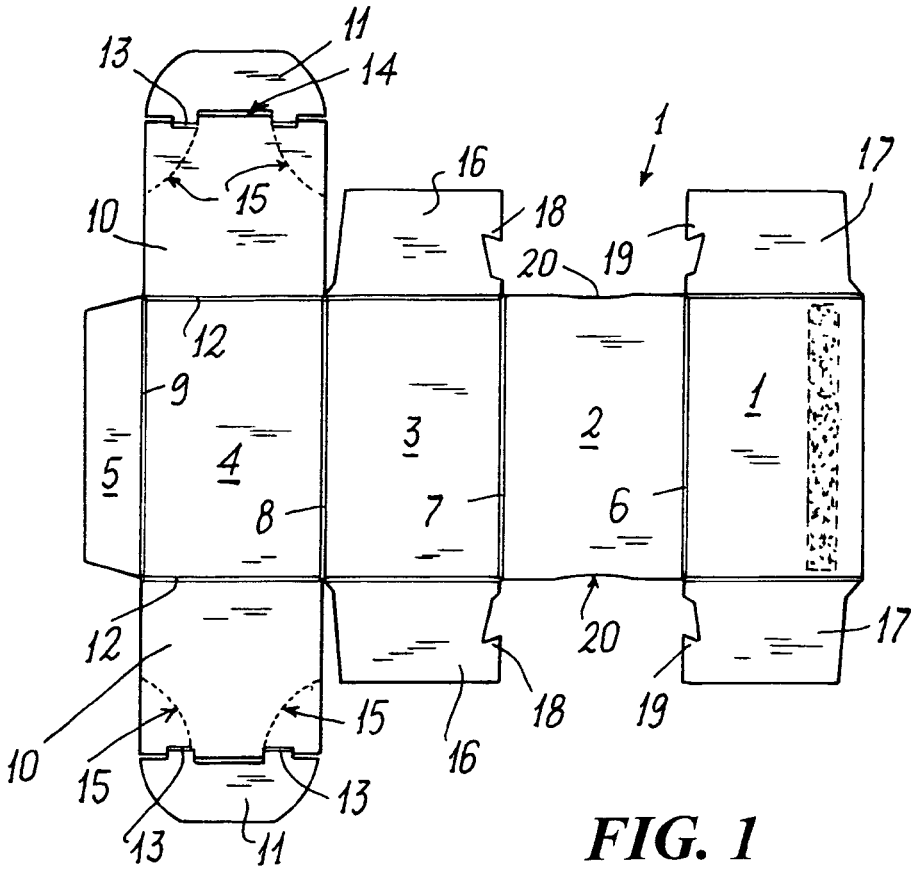
FIG. 1 is a plan view of a cardboard sheet usable to form the box.

With reference to FIG. 1, the box structure is formed from a thin flexible sheet 1, usually of punched, crease-lined and knurled cardboard.

The sheet 1 comprises four main walls 1-4 and an endpiece 5 separated from each other by parallel folding lines 6-9, to form the lateral walls of the box when the sheet is folded about the lines 6-9 and the endpiece 5 has been glued to the inside of the wall 1 in known manner.

From each end of the lateral wall 4 there projects a panel 10 from which a tab 11 extends to form with the panel the box base: the panel 10 is separated from the wall 4 and from the tab 11 by folding lines 12 and 13 respectively. The ends of the folding lines 13 are interrupted by short notches (in known manner), not numbered for simplicity; in the tab 11 there is provided a cut (defining a thin elongate window) 14 close to the folding line 13, whereas in each panel 10 there are provided two breakable knurlings 15 shaped as a circular arc and extending from the two ends of the window 14 to the adjacent free lateral edge of the panel 10.

From each end of the two lateral walls 1, 3 there projects a flap 16, 17 which is provided in proximity to its free end, in that edge distant from the panel 10 in the made-up box (FIG. 2), with a hook or dovetail shaped tooth 18, 19.

Figure 4:
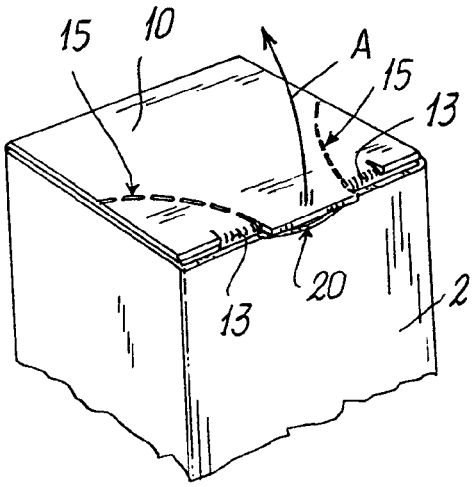
Figure 5:
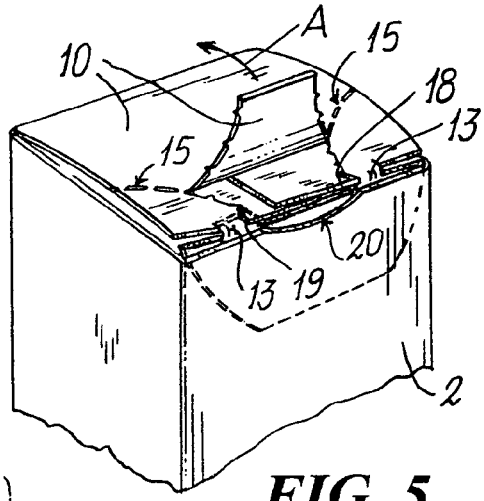
FIG. 5 is similar to FIG. 4 but shows the box during the first stage showing how the base appears when damaged in an attempt to open it.
Figure 6:
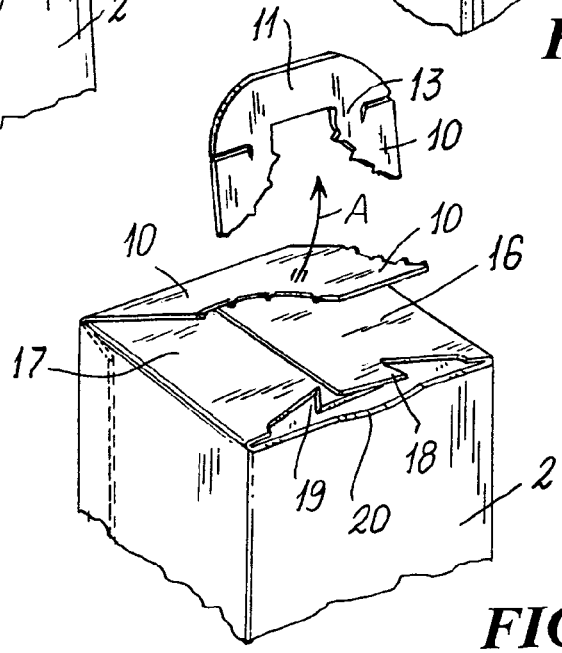
FIG. 6 is a perspective view showing the box base with a portion thereof torn away to enable the box to be opened.

The length of the flaps 16, 17 which lie at each end of the made-up box when closed is such that when they are folded onto themselves (FIGS. 3-6) the tooth 18 of the flap 17 becomes superposed on the tooth 19 of the flap 17, so that the two superposed teeth are positioned at the window 14 and project from it when the base of the box is closed (FIGS. 4 and 5).

Finally it should be noted that the central portion of the two free edges of the wall 2 are shaped to present a recess 20 which, in the box when closed, lies adjacent to the said cut 14.

Figure 2:
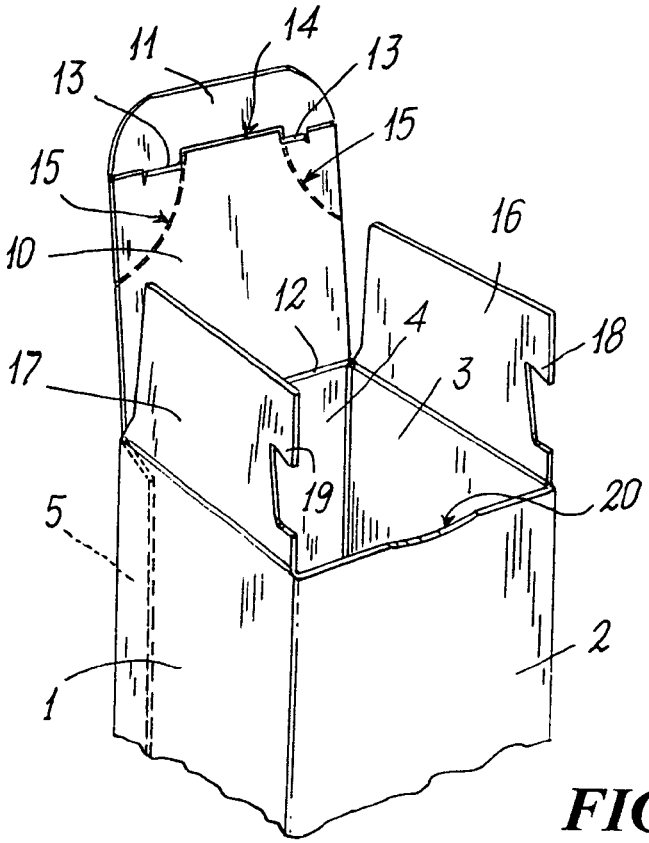
FIGS. 2 to 4 are perspective views of one end of a box during three successive stages of its formation, i.e. when this end is completely open, then during an intermediate stage in the closure of the base at that end of the box, and finally in the condition in which the base is completely closed.
Figure 3:
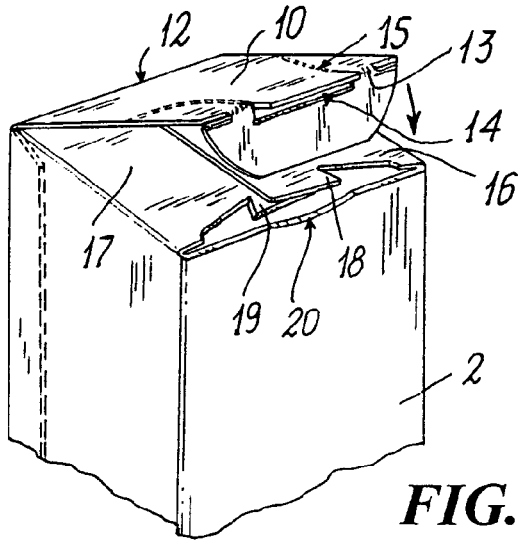

It will now be assumed that a cardboard sheet such as that shown in FIG. 1 is folded and glued in usual manner to form a finished box with its base open as represented in FIG. 2.

To close the box the two flaps 16, 17 are firstly turned one onto the other by rotating them about the folding lines which separate them from the respective lateral walls 1, 3, the tab 11 is folded about the panel 10 and this latter folded about its folding line 12 (FIG. 3), causing the tab 11 to penetrate completely between the lateral wall 2 and the flaps 16, 17 (FIG. 4): in this position, the flanks of the teeth 18, 19 (which are superposed on each other) lie positioned exactly in front of the cut 14 in the tab 11 and penetrate into it to project slightly beyond said tab 11, so that the hook-shaped ends of said teeth rest against the adjacent portions of the base where the folding lines 13 are provided.

As is apparent, above an outwards from the pair of superposed teeth 18, 19 there extends an appendix forming part of the panel 10 and branching from the cut 14 which has been provided in the tab 11 to form the window through which the teeth 18, 19 of the flaps extend.

The base of the box is hence retained securely in its closed position as the hook-shaped portions of the teeth 18, 19 hook securely onto the adjacent portions 13 of the base, to effectively resist its opening.

When the base of the box is to be opened, the appendix of the panel 10, superposed on the teeth 18, 19, is gripped with two fingers of one hand and pulled upwards (with respect to the figures) in the direction of the arrow A: the gripping of said appendix is facilitated by the presence of the recess 20 provided in the adjacent end of the box lateral wall 2. Initially, the pull in the direction of the arrow A causes breakage of the end portion of the knurlings 15 (FIG. 5) and finally total breakage of the knurlings 15 (FIG. 6), with consequent detachment of the tab 11 and of two end corner portions of the panel 10 from the main side of the panel 10, which can hence be freely raised and rotated about its folding line 12 to completely open the box.

It is important to note that the two knurlings 15 can be very easily broken as breakage takes place directly by manual pulling and not by the action of the teeth 18, 19 which merely contribute to maintaining the tab 11 (with the panel portions 10 rigid therewith) lowered in the closure position, and because the breakage of the knurlings commences at one of their ends (and not from an intermediate point on their length): breakage is also facilitated by the fact that the knurlings extend along circular arcs.

After it has been opened for the first time, the base or lid of the box lacks two of its corner portions and the tab 11, thus easily displaying the fact that the box has already been opened.

What is claimed is:

1. A box which has an opening-resistant base with break-off portions and is formed from a single piece of cardboard, comprising:

four lateral walls, at least one base projecting from an end of one of said lateral walls, two flaps each projecting from the end of one of said lateral walls of adjacent the wall from which said base projects, said base consisting of a panel projecting directly from the lateral wall of the box and a tab projecting from an end of said panel, the panel being separated from the respective lateral wall and from the tab by parallel folding lines, said flaps also being separated from the respective lateral walls by folding lines and each having a hook-shaped tooth provided in proximity to the free end of the flap on a side thereof opposite the box base panel, the length of the two flaps being such that when they are folded one towards the other in the box when closed, the hook-shaped tooth of one flap becomes superposed on the hook-shaped tooth of the other flap, there being provided in the box base tab, in proximity with the folding line which separates the box base tab from the base from which said box base tab projects, a single central cut through which the hook-shaped teeth projecting from the two flaps on which the base panel is superposed in the box when closed are positioned and extend, wherein a breakable knurling extends on said base panel from each end of said cut as far as an adjacent lateral edge of the base panel such that said box is openable only by tearing of said knurling.

2. A box as claimed in claim 1, wherein said knurlings extend along circular arcs.

3. A box as claimed in claim 2, wherein on an edge of a lateral wall of said lateral walls where the hook-shaped teeth are positioned within the box when closed, a central recess is provided lying adjacent to said cut provided in the tab of the box base.

* * * * *